US006918999B1

(12) United States Patent
Giertz et al.

(10) Patent No.: US 6,918,999 B1
(45) Date of Patent: Jul. 19, 2005

(54) DEVICE AND METHOD FOR SEALING LEVELLING DOOR APERTURE OF A COKE OVEN CHAMBER

(75) Inventors: Hans-Josef Giertz, Ratingen (DE); Friedrich-Wilhelm Cyris, Duisburg (DE); Friedrich Huhn, Ratingen (DE); Franz Liesewitz, Mülheim (DE)

(73) Assignee: Deutsche Montan Technologie GmbH, Essen (DE)

( * ) Notice: Subject to any disclaimer, the term of this patent is extended or adjusted under 35 U.S.C. 154(b) by 0 days.

(21) Appl. No.: 09/462,441

(22) PCT Filed: Jul. 6, 1998

(86) PCT No.: PCT/EP98/04157

§ 371 (c)(1),
(2), (4) Date: Mar. 20, 2000

(87) PCT Pub. No.: WO99/02625

PCT Pub. Date: Jan. 21, 1999

(30) Foreign Application Priority Data

Jul. 8, 1997 (DE) ..... 197 29 032

(51) Int. Cl.[7] ..... C10B 25/00; C10B 25/22

(52) U.S. Cl. ..... 202/242; 202/250; 202/251; 202/262; 202/263; 202/244; 202/245

(58) Field of Search ..... 202/242, 250, 202/251, 262, 263, 244, 245

(56) References Cited

U.S. PATENT DOCUMENTS 2,268,316 A 12/1941 Taylor
3,647,053 A * 3/1972 Palumbo ..... 201/1
3,821,088 A 6/1974 Barron
3,857,758 A * 12/1974 Mole ..... 201/40
3,859,066 A * 1/1975 Trutzschler ..... 55/401
3,968,014 A * 7/1976 Armour ..... 202/263
4,231,845 A * 11/1980 Vander et al. ..... 202/113
4,234,390 A * 11/1980 Van Egmond et al. ..... 202/262
4,264,263 A * 4/1981 Richmond, Jr. ..... 414/587
4,283,253 A * 8/1981 Polenz et al. ..... 201/30
4,359,362 A * 11/1982 Omae ..... 201/1
5,114,542 A * 5/1992 Childress et al. ..... 201/15
5,925,829 A * 7/1999 Laragione et al. ..... 73/861

FOREIGN PATENT DOCUMENTS

DE 1 127 868 9/1962

OTHER PUBLICATIONS

International Search Report, dated Nov. 4, 1998.

* cited by examiner

*Primary Examiner*—Glenn Caldarola
*Assistant Examiner*—Alexis Wachtel
(74) *Attorney, Agent, or Firm*—Fay Sharpe Fagan Minnich & Mckee; Robert V. Vickers; Brian E. Turung

(57) ABSTRACT

The invention relates to a device for sealing a leveling door aperture of a coke oven chamber when loading bulk coking coal. The device includes a housing and a leveling door aperture, a leveling arm, composed of at least side panels and cross spacers connecting the side panels, is guided through the housing and the leveling door aperture. The leveling arm supports means for sealing a cross-sectional area of the leveling door aperture or upstream the leveling door aperture. A controllable or adjustable exhauster is joined to the housing and a measurement point is provided for flow rate measurement.

28 Claims, 5 Drawing Sheets

DEVICE AND METHOD FOR SEALING LEVELLING DOOR APERTURE OF A COKE OVEN CHAMBER

The present invention claims priority on PCT Patent Application Serial No. PCT/EP98/04157 filed Jul. 6, 1998, which in turn claims priority on German Patent Application Serial No. 197 29 032.9 filed Jul. 8, 1997.

The invention relates to a device and method for sealing a leveler door opening of a coke oven chamber.

BACKGROUND OF THE INVENTION

During the coking of hard coal, the coking coal is typically poured into the coke oven chamber through charging holes in the chamber roof. With this so-called top charging, cones of repose form underneath the charging holes, which must be leveled off by a leveling device to fully utilize the chamber area and leave a free exhaustion space for the charging gases underneath the chamber roof.

The leveling apparatus has a leveler bar, which can be inserted into the oven chamber from the outside through a so-called leveler door opening and which is typically mounted on the coke pusher machine, hereinafter referred to as pusher. This pusher can be moved along the coke oven battery from one coke oven chamber to the next so that the ram can push the carbonized coke cake out of the oven chamber toward the opposite coke oven side and the leveling apparatus can subsequently level the coking coal when the coke oven chamber is recharged. Furthermore, the pusher is provided with actuating devices for opening and closing or locking the coke oven chamber doors located on the machine side and the leveler doors closing the leveler door opening.

DE 33 40 067 C2 discloses a sealing device for a leveler door opening provided with a housing that can be connected to the leveler opening to form a seal. A delivery tube branches off from the housing to an adjacent coke oven chamber.

DE-AS 11 27 868 discloses a device to prevent the emission of charging gases through the leveler opening, which is provided with a tube enclosing the leveler bar whose length is approximately equal to the distance between two adjacent cross bars of the leveler bar.

U.S. Pat. No. 2,268,316 describes sealing sheet metal plates, which seal the gap between the leveler door opening and the leveler bar during the leveling operation.

From DE 23 64 458 C3 it is known to connect a housing, through which the leveler bar is guided, to the leveler door opening so as to form a seal. This housing is connected to both a forced draught fan and an exhaust fan. The forced draught fan is used to blow air through nozzles in the direction of the leveler door opening where it is exhausted by the exhaust fan. Suction may be adjusted by means of a restrictor so as to create an air seal in the housing outside the leveler door opening, which is to prevent gases and flames from exiting through the leveler door opening. In this manner, a closed area is to be created in front of the leveler door opening where pressure builds up corresponding to the pressure in the coke oven chamber so that there is no noticeable pressure difference between the coke oven chamber and the space in front of the leveler door opening. This device basically prevents the emission of charging gases through the leveler door opening. However, a complex apparatus is required. Suction adjustment by means of a restrictor is relatively inexact such that under certain circumstances air may be blown into the coke oven chamber or charging gases may be sucked out of the coke oven chamber.

In view of the problems associated with prior art leveler door openings, there is a need for a leveler door opening that can inhibit or prevent the emission of charging gases through the leveling door opening.

SUMMARY OF THE INVENTION

The present invention is directed to a simple device and method to ensure a sealed area outside the leveler door opening and thus to prevent the emission of charging gases through the leveler door opening.

In accordance with the present invention, there is provided a device for sealing a leveler door opening of a coke oven chamber during the top charging of the coking coal. The device is provided with a housing that is connectable to the leveler door opening so as to form a seal, through which is a guided leveler bar. The leveler bar includes side segments and cross segments connecting the latter. The housing is also provided with an arrangement for sealing the cross sectional area of the opened leveler door or in front of the opened leveler door. A regulatable or controllable exhaust fan is connected to the housing and a measuring location is provided for flow measurement.

The invention is based on the idea that the partial vacuum existing in the coke oven chamber during the charging operation with coking coal is also maintained in the area of the leveler door.

In an area in front of the opened leveler door opening, or in front of and/or in the leveler door opening, a seal is provided whose sealing function corresponds to a closed leveler door. The area in front of and/or in the leveler door opening may be achieved either by fluidic means, i.e. by creating pressure equality in front of and behind the leveler door opening to create a no-flow zone, or by mechanically sealing the leveler bar.

In accordance with one aspect of the present invention, the exhaust fan is adjusted such that there is no longer any flow in the area in front of the leveler door opening. This creates a no-flow zone in the region in front of and/or in the leveler door opening. Flow in this area is measured at a measuring location and the measuring signal is used to regulate or control the exhaust fan.

In accordance with another and/or alternative aspect of the present invention, the exhaust fan can be adjusted such as to permit a small amount of ambient air to be sucked into the coke oven chamber. This has only a negligible effect on the exhaustion of the charging gases. In any case, this mode of operation also prevents the emission of charging gas through the leveler door opening.

In accordance with still another and/or alternative aspect of the present invention, the outlet of the exhaust fan is connected with an adjacent coke oven chamber. This mode of operation uses the partial vacuum of the adjacent coke oven chamber. In this case, suction is operated in such a way that charging gases are sucked into the adjacent oven.

In accordance with yet another and/or alternative aspect of the present invention, the space in front of the leveler door opening is mechanically sealed to prevent the emission of charging gases. The leveler bar is sealed by sealing plates above and below. Along the sides, the leveler bar is sealed by sealing strips. Together with the cross segments this external leveler bar seal forms a closed hollow box since the sealing plates seal at least the area of two cross segments.

In accordance with still yet another and/or alternative aspect of the present invention, the sealing plates can be positioned in such a way that they are supported against the side segments, the cross segments or the side and cross segments of the leveler bar. However, pressure means, such as springs, may also be used to press them against the side segments of the leveler bar. The seal may also can be reinforced by the sealing strips that are pressed against the side segments of the leveler bar, for example by means of springs.

In accordance with a further and/or alternative aspect of the present invention, the sealing plates also can be arranged in the housing in such a way that a partial vacuum within the leveler bar presses them against the leveler bar, which again increases the sealing effect.

In accordance with still a further and/or alternative aspect of the present invention, the sealing plates may be rounded and/or beveled along their edges. This prevents the leveler bar from knocking against the edges of the sealing plates during the leveling process. The sealing plate also can be divided into several segments. This improves the seal provided by the sealing plate if the leveler bar is uneven or has a variable cross section.

In accordance with yet a further and/or alternative aspect of the present invention, a plurality of sealing plates and sealing strips are disposed within the housing one behind the other. This again increases the sealing effect.

In accordance with still yet a further and/or alternative aspect of the present invention, the sealing plates can be equipped with wear protection to improve their durability. When sealing plates are used, the housing can be eliminated since a housing is formed by the sealing plates and the side segments of the leveler bar.

In accordance with another and/or alternative aspect of the present invention, the coal spillage collector can be disposed anywhere outside the area of the sealing plates.

In accordance with still another and/or alternative aspect of the present invention, the sealing plates are arranged in the housing to seal the leveler bar from above and below at least over the area of the two cross segments and the sealing strips are arranged to seal the side segments of the leveler bar.

In accordance with yet another and/or alternative aspect of the present invention, the sealing plates and the sealing strips are provided with press-on means.

In accordance with still yet another and/or alternative aspect of the present invention, the sealing plates are held in the housing such that they are pressed against the leveler bar by a partial vacuum.

In accordance with a further and/or alternative aspect of the present invention, the sealing plates are rounded and/or beveled.

In accordance with still a further and/or alternative aspect of the present invention, a plurality of sealing plates and a plurality of sealing strips are arranged one behind the other in the leveler bar thrust direction.

In accordance with yet a further and/or alternative aspect of the present invention, the housing is formed by the sealing plates and the side segments of the leveler bar.

In accordance with still yet a further and/or alternative aspect of the present invention, a seal of the inside cross section of the leveler bar is provided between the side segments. These sealing elements must be made flexible so that they can avoid the cross segments of the leveler bar. The area between the side segments of the leveler bar and the housing is sealed by one or more sealing strips arranged one behind the other.

In accordance with another and/or alternative aspect of the present invention, the rotary locks are arranged in the housing. This is the simplest solution. The rotary locks can be arranged hanging inside the housing, for example in a one-piece flap design. They seal off the cross section between the side segments of the leveler bar. If the leveler bar moves, the leveler bar cross segments press against the rotary lock upon approach and contact. The rotary lock is pushed aside and conforms to the upper edge of the leveler bar cross segment to form a seal. If the leveler bar continues to move, the rotary lock swings back into the space between the side segments and seals it until the next cross segment is reached.

In accordance with still another and/or alternative aspect of the present invention, a seal is formed inside the cross section of the leveler bar by means of cell wheels. Cell wheels are arranged in a cell wheel housing above and/or below the leveler bar such that the cell wheel vanes overlappingly engage between the leveler bar side segments. If the leveler bar moves, the cross segments cause the cell wheels to rotate.

In accordance with yet another and/or alternative aspect of the present invention, the lower cell wheel housing can be equipped with an excess coal discharge unit.

In accordance with still yet another and/or alternative aspect of the present invention, the cell wheel also can be dimensioned in such a way that the cell wheel vanes, similarly to the rotary locks, seal the entire cross section between the leveler bar side segments. In this case a sealing plate is disposed in the lower portion of the housing opposite the cell wheel. This sealing plate seals at least the area of two leveler bar cross segments and may also be formed by the bottom plate of a housing enclosing the leveler bar.

In accordance with a further and/or alternative aspect of the present invention, an inner leveler bar seal is formed by installing movable rollers in a roller housing. The rollers are dimensioned in such a way that they take up and seal the entire cross section between the leveler bar side segments. The rollers may move up and down within the roller housing and thus avoid the cross segments of the leveler bar.

In accordance with still a further and/or alternative aspect of the present invention, a plurality of seals can be arranged within the housing.

In accordance with yet a further and/or alternative aspect of the present invention, the exhaust fan is combined with the seal by sealing plates and/or movable sealing elements.

In accordance with still yet a further and/or alternative aspect of the present invention, the housing also can be made large enough so that the leveler door may be opened and locked within the housing.

In accordance with another and/or alternative aspect of the present invention, there is provided a device for sealing a leveler door opening of a coke oven chamber during the top charging of the coking coal. The device is provided with a housing that is connectable to the leveler door opening so as to form a seal, through which is guided a leveler bar. The leveler bar includes side segments and cross segments connecting the latter. The housing is also provided with an arrangement for sealing the cross sectional area of the opened leveler door or in front of the opened leveler door. Moveable sealing elements are provided to seal the inner cross section of the leveler bar between the side segments.

In accordance with still another and/or alternative aspect of the present invention, at least one moveable sealing element is at least one rotary lock.

In accordance with yet another and/or alternative aspect of the present invention, at least one moveable sealing element is at least one cell wheel. In still another embodiment, at least one sealing plate is arranged in the housing.

In accordance with still yet another and/or alternative aspect of the present invention, at least one moveable sealing element is at least one moveable roller.

In accordance with a further and/or alternative aspect of the present invention, the exhaust fan and/or the sealing plates and/or the moveable sealing elements are arranged on the housing.

In accordance with still a further and/or alternative aspect of the present invention, the leveler bar forms a seal in the housing and gas exhaustion is affected in the housing by the seal. In one aspect of this embodiment, the gas exhaustion in the housing is regulated or controlled based on a flow measurement taken in the area of the leveler door opening in such a way that there is essentially no gas flow at that location.

The aforementioned components as well as the components claimed and described in the exemplary embodiments to be used according to the invention are not subject to any restrictions with respect to their size, form, material selection and technical design so that the selection criteria known in the respective area of application may be used without reservation.

In summary, there is provided a device to seal a leveler door opening of a coke oven chamber during top charging of the coking coal. The device is provided with a housing that is connectable to the leveler door opening so as to form a seal, through which is guided leveler bar. The leveler bar includes side segments and cross segments connecting the latter. The housing is also provided with an arrangement to seal the cross sectional area of the opened leveler door or in front of the opened leveler door. A regulatable or controllable exhaust fan is connected to the housing and a measuring location is provided for flow measurement. In one arrangement, the outlet of the exhaust fan is connected to an adjacent coke oven chamber. In another arrangement, the sealing plates are arranged in the housing to seal the leveler bar from above and below at least over the area of the two cross segments. The sealing strips are arranged to seal the side segments of the leveler bar. In yet another arrangement, the sealing plates and the sealing strips are provided with press-on means. In still another arrangement, the sealing plates are held in the housing such that they are pressed against the leveler bar by a partial vacuum. In still yet another arrangement, the sealing plates are rounded and/or beveled. In a further arrangement, a plurality of sealing plates and a plurality of sealing strips are arranged one behind the other in the leveler bar thrust direction. In yet a further arrangement, the housing is formed by the sealing plates and the side segments of the leveler bar. In still a further arrangement, there are provided moveable sealing elements that seal the inner cross section of the leveler bar between the side segments. In still yet a further arrangement, at least one moveable sealing element is at least one rotary lock. In another arrangement, at least one moveable sealing element is at least one cell wheel. In still another arrangement, at least one sealing plate is arranged in the housing. In yet another arrangement, at least one moveable sealing element is at least one moveable roller. In still yet another arrangement, the exhaust fan and/or the sealing plates and/or the moveable sealing elements are arranged on the housing. In a further arrangement, there is provided a housing having a leveler door opening through which a leveler bar is guided and is connected to the leveler door opening. The leveler bar forms a seal in the leveler door opening thereby affecting gas exhaustion in the housing. The gas exhaustion in the housing is regulated or controlled based on a flow measurement taken in the area of the leveler door opening in such a way that there is essentially no gas flow at that location.

Additional details, features and advantages of the subject of the invention will become evident from the following description of the associated drawing, which depicts preferred embodiments of the device for a leveler door opening by way of example as shown in the accompanying drawings.

DETAILED DESCRIPTION OF THE INVENTION

Figure 1:
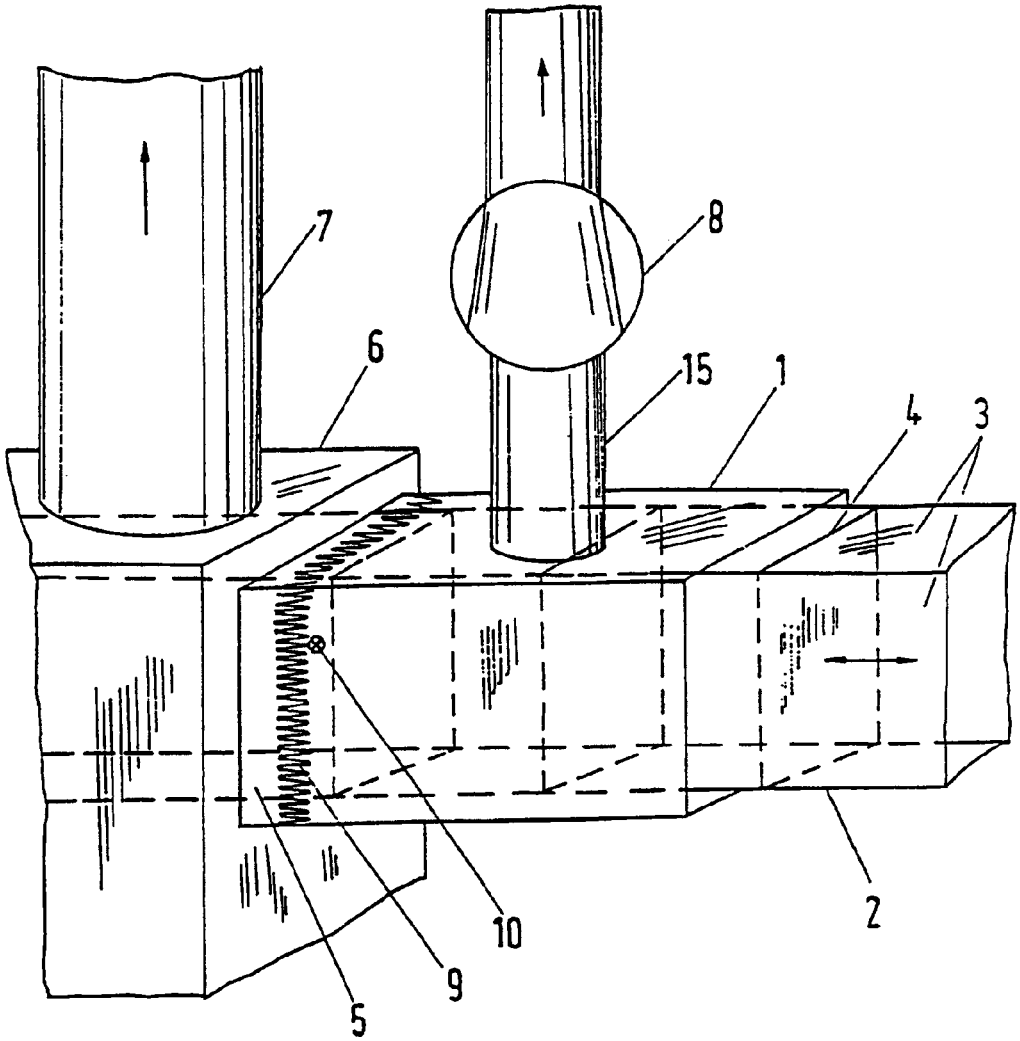
FIG. 1 is a perspective view of an embodiment of the sealing device with exhaust fan.

Referring now to the drawings wherein the showings are for the purpose of illustrating the preferred embodiments only and not for the purpose of limiting same, FIG. 1 shows a housing 1 open at its two opposite ends in which a leveler bar 2 open at the top and at the bottom and provided with side segments 3 and cross segments 4 may be inserted and retracted. Housing 1 fits against the circumference of a leveler door opening 5 of a coke oven chamber 6 with a ascension pipe 7 so as to form a seal. Above housing 1 is an exhaust fan 8 with a suction pipe 15 that is connected to housing 1. A regulating or control unit (not shown) adjusts the exhaust fan so that there is essentially no gas flow in housing 1 near leveler door opening 5 of coke oven chamber 6. Instead, a no-flow zone 9 is formed in an area located between the interior of coke oven chamber 6 and the end of housing 1 or suction pipe 15 that is remote from leveler door opening 5. The charging gases are exhausted through ascension pipe 7 while ambient air is exhausted through exhaust fan 8 so that it does not reach the coke oven chamber. Any flow is sensed at a measuring location 10.

Figure 2:
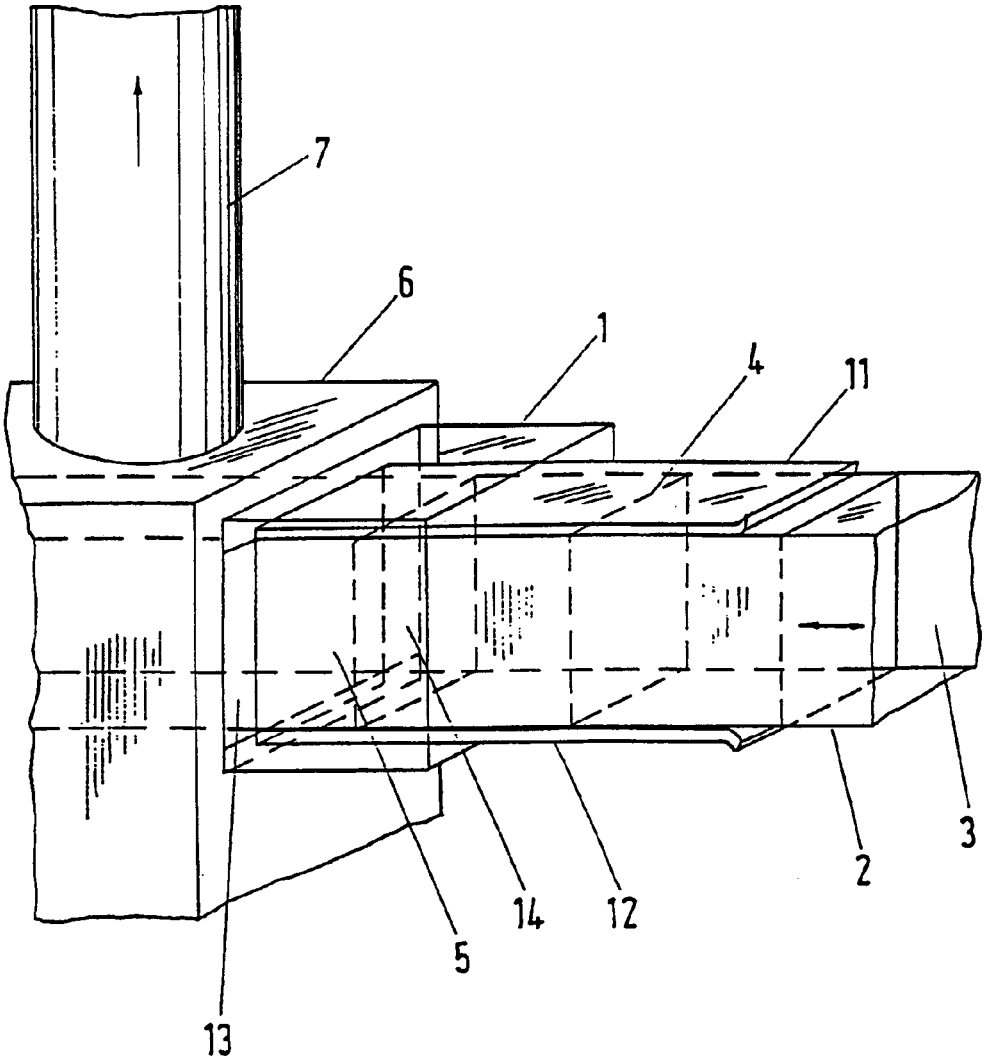
FIG. 2 is a second embodiment with sealing plates and sealing strips.

FIG. 2 shows that sealing plates 11 and 12 are arranged inside housing 1 above and below leveler bar 2, which is open at the. top and the bottom. Sealing plates 11 and 12 fit against the upper and lower edges of side segments 3 and cross segments 4 of leveler bar 2 and protrude from housing 1 at the housing end that is remote from coke oven chamber 6. Sealing plates 11 and 12 are made longer than the distance between two cross segments 4 serving as leveler segments. As a result, leveler door opening S is always sealed toward the outside during the leveling operation by at least one cross segment 4 of leveler bar 2. Side segments 3 of leveler bar 2 are also sealed by sealing strips 13 and 14.

Figure 3:
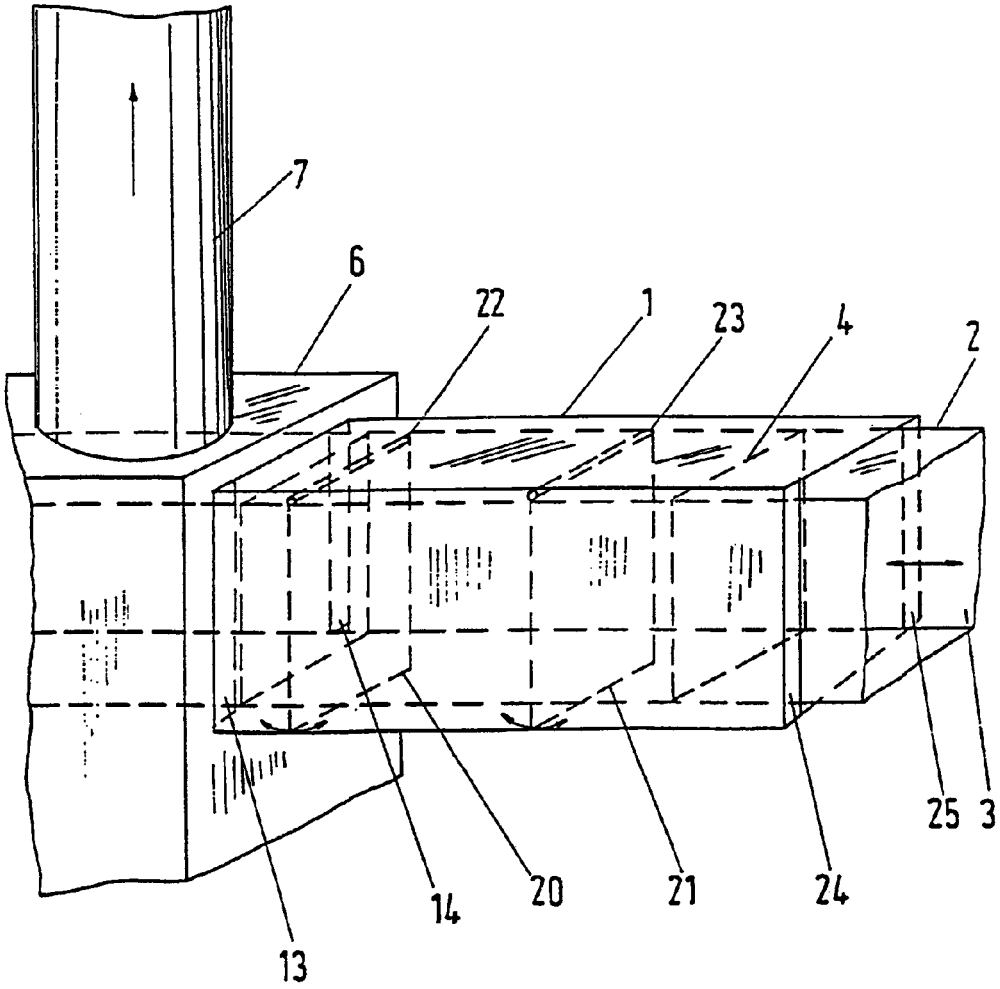
FIG. 3 is a third embodiment with rotary locks.

FIG. 3 illustrates sealing by means of rotary locks. Two rotary locks 20 and 21 capable of rotating around rotary axes 22 and 23 are shown inside housing 1. The other reference numbers have the same meaning as those in the preceding figures. Rotary locks 20 and 21 seal the inner cross section between side segments 3 of leveler bar 2 as well as the cross sectional housing areas above and below that. Sealing strips 13, 14 and 24, 25 seal the side segments 3 of the leveler bar 2 toward the outside. When leveler bar 2 moves into coke oven chamber 6, cross segments 4 knock against rotary locks 21 and 22. The rotary locks avoid cross segments 4 by a rotational movement, respectively, and reseal the area between side segments 3 of leveler bar 2 after they move back into position.

Figure 4:
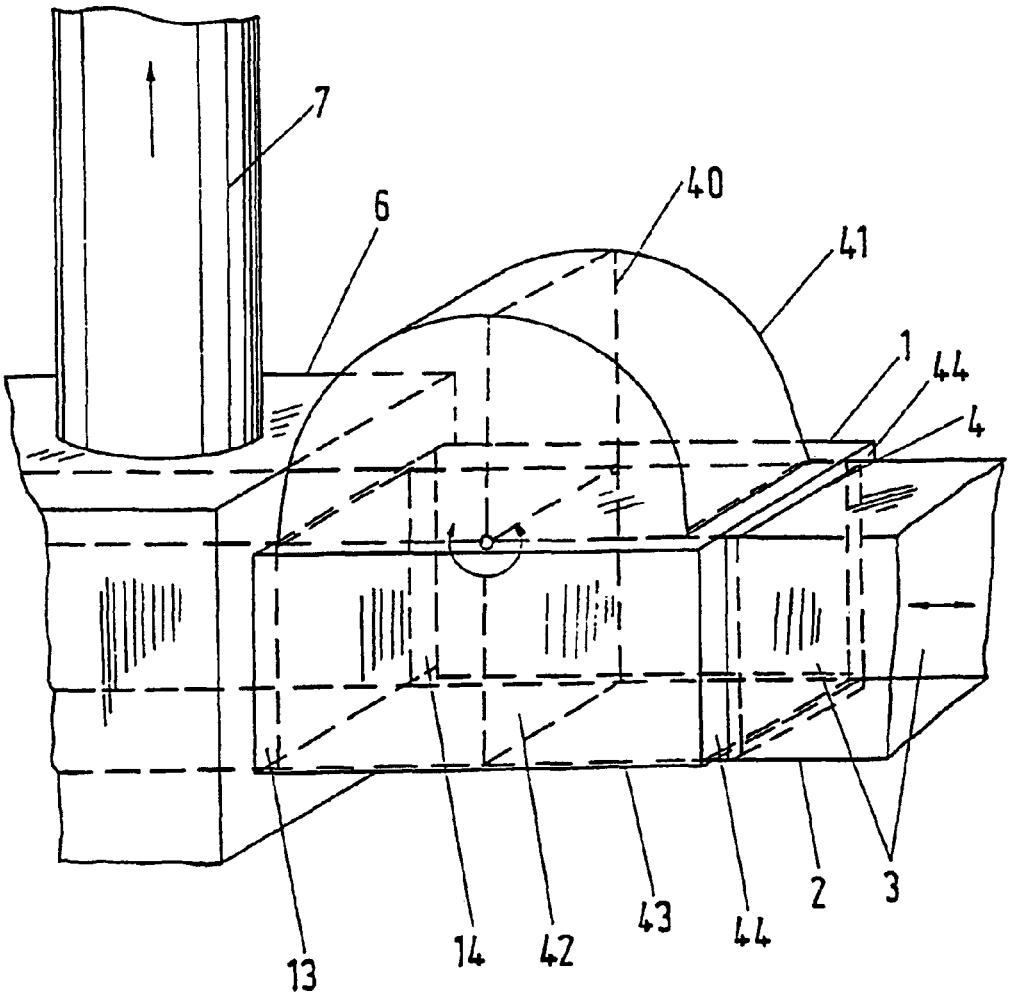
FIG. 4 is a fourth embodiment with a cell wheel and a sealing plate.

FIG. 4 shows a four-vane cell wheel 40 in a cell wheel housing 41 whose cell wheel vanes 42 cover the entire cross section between side segments 3 of leveler bar 2. Below leveler bar 2, there is a sealing plate 43, which fits against the lower edges of side segments 3 to form a seal. As leveler bar 2 is inserted or retracted, cell wheel 40 is respectively rotated by another 90° whenever cross segment 4 passes under the cell wheel axle.

Figure 5:
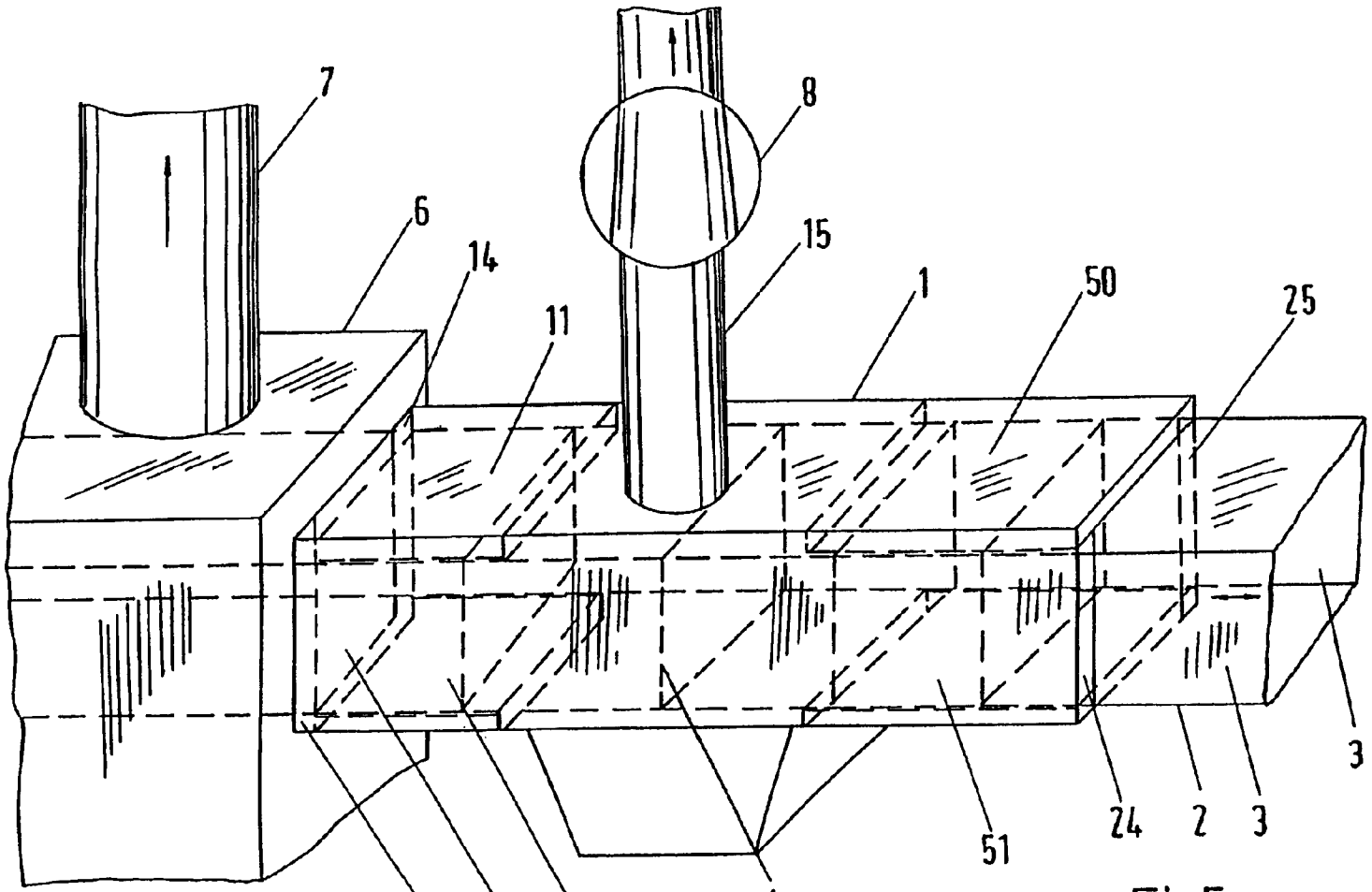
FIG. 5 is a fifth embodiment combining a plurality of sealing plates with an exhaust fan.

FIG. 5 depicts a combination of different sealing options. FIG. 5 shows that leveler bar 2 is sealed with additional sealing plates 50 and 51 located above and below, respectively. Furthermore, an exhaust fan 8 is connected to housing 1 via suction pipe 15. The other reference numbers have the same meaning as those in the preceding figures. A coal spillage collector 52 is disposed below housing 1.

List of Reference Numbers

1 housing
2 leveler bar
3 side segments
4 cross segments (leveling segments)
5 leveler door opening
6 coke oven chamber
7 ascension pipe
8 exhaust fan
9 no-flow zone
10 measuring location
11 sealing plate
12 sealing plate
13 sealing strip
14 sealing strip
15 suction pipe
20 rotary lock
21 rotary lock
22 rotary axis
23 rotary axis
24 sealing strip
25 sealing strip
40 cell wheel
41 cell wheel housing
42 cell wheel vane
43 sealing plate
44 sealing strip
50 sealing plate
51 sealing plate
52 coal spillage collector The invention has been described with reference to a preferred embodiment and alternates thereof. It is believed that many modifications and alterations to the embodiments disclosed will readily suggest itself to those skilled in the art upon reading and understanding the detailed description of the invention. It is intended to include all such modifications and alterations insofar as they come within the scope of the present invention.

What is claimed is:

1. A device to at least partially seal a leveler door opening of a coke oven chamber during top charging of the coking coal comprising a housing having a first end opening connectable to the leveler door opening, a leveler bar guidable into a second end opening and at least partially through an interior passageway of said housing and at least partially through said leveler door opening, said leveler bar including at least two side segments and at least one cross segment connecting said two side segments, said housing provided with a sealing mechanism to at least partially inhibit a flow of gases in front of said leveler door opening by creating a no-flow zone in a region in at least closely adjacent to the front of said leveler door opening, said sealing mechanism including a regulatable exhaust fan connected to said housing to expel gas substantially comprising air through an outlet opening in said housing and a flow measuring mechanism at least partially positioned in said housing between the coke oven and said outlet opening, said outlet opening positioned between said first and second end openings of said housing, said flow measuring mechanism at least partially controlling said regulatable exhaust fan to control a volume of said expelled gas through said outlet opening.

2. The device of claim 1, wherein said leveler bar includes at least two of said cross segments and said housing having two sealing plates secured to said housing and extending outwardly from said second end opening of said housing, said sealing plates at least partially sealing gas between at least two of said cross segments of said leveler bar that are spaced outwardly from said second end opening, said two sealing plates positioned substantially parallel to one another and oriented above and below said two cross segments when said leveler bar passes between said two sealing plates.

3. The device of claim 2, wherein said two sealing plates includes a sealing arrangement to at least partially seal said side segments of said leveler bar, said sealing arrangement includes sealing strips and sealing plates provided with press-on means.

4. The device of claim 3, wherein said sealing plates are held in said housing by a partial vacuum, said partial vacuum pressing said sealing plates against said leveler bar.

5. The device of claim 3, wherein said sealing plates are beveled.

6. The device of claim 3, including a plurality of said sealing plates and a plurality of sealing strips being arranged one behind the other in an axial direction, said axial direction defining a thrust direction for said leveler bar.

7. The device of claim 3, wherein said housing at least partially surrounds said sealing plates and said side segments of said leveler bar.

8. A device to at least partially seal a leveler door opening of a coke oven chamber during top charging of the coking coal comprising a housing having a first end opening connectable to the leveler door opening so as to form a seal, a leveler bar guided into a second end opening and at least partially through an interior passageway of said housing and at least partially through said leveler door opening, said leveler bar including at least two side segments and at least two cross segments connecting said two side segments, said housing provided with a sealing mechanism to at least partially inhibit a flow of gases in front of said leveler door opening by creating a no-flow zone in a region in at least closely adjacent to the front of said leveler door opening, said sealing mechanism including at least one movable sealing element to at least partially seal an inner cross section of said leveler bar between said side segments and at least two sealing plates arranged in said housing, said at least one movable sealing element includes at least one pivoting seal having a pivotable panel wherein the pivotable panel is movable between at least two of said cross segments of said leveler bar, at least one cell wheel having a plurality of panels rotatable about an axis wherein at least one of said panels is movable between at least two of said cross segments of said leveler bar, and combinations thereof, said sealing plates secured to said housing and extending outwardly from said second end opening of said housing, said sealing plates at least partially sealing gas between at least two of said cross segments of said leveler bar that are spaced outwardly from said second end opening, said two sealing plates positioned substantially parallel to one another and oriented above and below said two cross segments when said leveler bar passes between said two sealing plates.

9. A method for sealing a leveler door opening of a coke oven chamber during a leveling process including providing a housing about the leveler door opening and guiding a leveler bar at least partially though said housing and said leveler door opening, forming a seal between said leveler door opening and said leveler, the improvement comprising regulating exhaustion of gas substantially comprising air from said housing by measuring the flow of gas through the leveler door opening and controlling the rate of said gas exhaustion from said housing in order that there is effectively no gas flow through said leveler door opening.

10. A device to at least partially seal a leveler door opening of a coke oven chamber during top charging of the coking coal comprising a housing having a first end opening at least partially connectable to the leveler door opening and at least partially encircling said leveler door opening, a leveler bar at least partially moveable into a second end opening of said housing and at least partially through an interior passageway of said housing and guidable at least partially through said leveler door opening, said leveler bar including at least two side segments and at least one cross segment connecting said two side segments, said housing provided with a sealing mechanism to inhibit a flow of gases in front of said leveler door opening by creating a no-flow zone in a region in at least closely adjacent to the front of said leveler door opening, said sealing mechanism including a regulatable exhaust fan connected to said housing to expel gas substantially comprising air through an outlet opening in said housing and a flow measuring mechanism at least partially positioned in said housing between the coke oven and said outlet opening, said outlet opening positioned between said first and second end openings of said housing, said flow measuring mechanism measuring gas flow through said leveler door opening, said flow measuring mechanism at least partially controlling said regulatable exhaust fan to control a flowrate of said expelled gas through said outlet opening so as to substantially reduce the flow of gas through said leveler door opening.

11. The device as defined in 10, wherein said regulatable exhaust fan at least partially directs said expelled gas into an adjacent coke oven chamber.

12. The device as defined in claim 10, wherein said leveler bar includes at least two of said cross segments and said housing having two sealing plates secured to said housing and extending outwardly from said second end opening of said housing, said sealing plates at least partially sealing gas between at least two of said cross segments of said leveler bar that are spaced outwardly from said second end opening, said two sealing plates positioned substantially parallel to one another and oriented above and below said two cross segments when said leveler bar passes between said two sealing plates.

13. The device as defined in claim 11, wherein said leveler bar includes at least two of said cross segments and said housing having two sealing plates secured to said housing and extending outwardly from said second end opening of said housing, said sealing plates at least partially sealing gas between at least two of said cross segments of said leveler bar that are spaced outwardly from said second end opening, said two sealing plates positioned substantially parallel to one another and oriented above and below said two cross segments when said leveler bar passes between said two sealing plates.

14. The device as defined in claim 10, including a seal arrangement to at least partially form a leveler seal between an outer surface of said leveler bar and an interior surface of said housing, said leveler seal including sealing strips, sealing plates and combinations thereof.

15. The device as defined in claim 13, including a seal arrangement to at least partially form a leveler seal between an outer surface of said leveler bar and an interior surface of said housing, said leveler seal including sealing strips, sealing plates and combinations thereof.

16. The device as defined in claim 14, wherein said leveler seal is provided with press-on means.

17. The device as defined in claim 15, wherein said leveler seal is provided with press-on means.

18. The device as defined in claim 14, wherein said sealing plates are at least partially held in said housing by a partial vacuum, said partial vacuum at least partially causing said sealing plates to press against said leveler bar.

19. The device as defined in claim 17, wherein said sealing plates are at least partially held in said housing by a partial vacuum, said partial vacuum at least partially causing said sealing plates to press against said leveler bar.

20. The device as defined in claim 14, wherein said sealing plates are at least partially beveled.

21. The device as defined in claim 19, wherein said sealing plates are at least partially beveled.

22. The device as defined in claim 14, wherein a plurality of said sealing plates and a plurality of sealing strips are arranged one behind the other in an axial direction, said axial direction defining a thrust direction for said leveler bar.

23. The device as defined in claim 19, wherein a plurality of said sealing plates and a plurality of sealing strips are arranged one behind the other in an axial direction, said axial direction defining a thrust direction for said leveler bar.

24. A method for at least partially sealing a leveler door opening of a coke oven chamber during the leveling process comprising:

a providing a housing having a first end opening at least partially connectable to the leveler door opening;

b. providing a leveler bar;

c. moving and at least partially guiding said leveler bar at least partially through said housing and said leveler door;

d. monitoring gas flow through said leveler door opening; and, e. at least partially regulating exhaustion of gas substantially comprising air from said housing by measuring a flow of gas through the leveler door opening and controlling a rate of said gas exhaustion from said housing in order that there is effectively no gas flow through said leveler door opening while said leveler bar moves through said leveler door opening.

25. The method as defined in claim 24, wherein said leveler bar includes at least two side segments and at least one cross segment connecting said two side segments.

26. The method as defined in 24, including the step of at least partially directing said exhausted gas into an coke oven chamber.

27. The method as defined in claim 24, including a sealing arrangement to inhibit gas flow between said housing and said leveler bar, said seal arrangement includes at least two sealing plates, at least one sealing strip, and combinations thereof.

28. The method as defined in claim 24, wherein said leveler bar includes at least two of said cross segments and said at least two sealing plates being secured to said housing and extending outwardly from a second end opening of said housing, said sealing plates at least partially sealing gas between at least two of said cross segments of said leveler bar that are spaced outwardly from said second end opening, said two sealing plates positioned substantially parallel to one another and oriented above and below said two cross segments when said leveler bar passes between said two sealing plates.

* * * * *